US008107667B2

(12) United States Patent
Beer et al.

(10) Patent No.: US 8,107,667 B2
(45) Date of Patent: Jan. 31, 2012

(54) LOUDSPEAKER DIAPHRAGM AND METHOD FOR MANUFACTURING A LOUDSPEAKER DIAPHRAGM

(75) Inventors: Daniel Beer, Martinroda (DE); Heinz Gensicke, Bad Lippspringe (DE); Sandra Brix, Ilmenau (DE); Thomas Sporer, Fuerth (DE); Martin Kuster, MecHangen (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 1176 days.

(21) Appl. No.: 11/765,966

(22) Filed: Jun. 20, 2007

(65) Prior Publication Data

US 2008/0089549 A1 Apr. 17, 2008

Related U.S. Application Data

(63) Continuation of application No. PCT/EP2005/013669, filed on Dec. 19, 2005.

(30) Foreign Application Priority Data

Dec. 20, 2004 (DE) ..... 10 2004 061 314

(51) Int. Cl.
*H04R 25/00* (2006.01)

(52) U.S. Cl. ..... 381/423; 381/398; 381/152

(58) Field of Classification Search ..... 381/152, 381/353, 354, 398, 403, 423, 424, 425, 426, 381/431; 181/157, 166, 167, 171, 172, 173, 181/174

See application file for complete search history.

(56) References Cited

U.S. PATENT DOCUMENTS

| | | | | |
|---|---|---|---|---|
| 3,172,498 | A * | 3/1965 | Gorike | 181/167 |
| 5,143,790 | A | 9/1992 | Sattinger | |
| 6,826,285 | B2 * | 11/2004 | Azima | 381/152 |
| 6,862,361 | B2 * | 3/2005 | James et al. | 381/423 |
| 2002/0044668 | A1 | 4/2002 | Azima | |

FOREIGN PATENT DOCUMENTS

| | | |
|---|---|---|
| AT | 1017080 | 12/1966 |
| CN | 1470148 A | 1/2004 |
| DE | 1 172 731 | 6/1962 |
| DE | 2112516 | 3/1971 |
| KR | 2001-74943 | 9/2001 |
| WO | PCT/GB99/02724 | 9/1999 |
| WO | 02/13575 A1 | 2/2002 |

OTHER PUBLICATIONS

Official Communication issued in corresponding Chinese Patent Application No. 200580047499.0, mailed on Jan. 12, 2011.

* cited by examiner

*Primary Examiner* — Huyen D. Le
(74) *Attorney, Agent, or Firm* — Keating & Bennett, LLP

(57) ABSTRACT

A loudspeaker diaphragm includes a tapering edge region. Thus, it is possible to prevent or considerably reduce wave reflection and uncontrolled wave propagation caused thereby in a cheap and effective manner.

19 Claims, 5 Drawing Sheets

LOUDSPEAKER DIAPHRAGM AND METHOD FOR MANUFACTURING A LOUDSPEAKER DIAPHRAGM

CROSS-REFERENCE TO RELATED APPLICATIONS

This application is a continuation of copending International Application No. PCT/EP2005/013669, filed Dec. 19, 2005, which designated the United States and was not published in English, which is incorporated by reference herein in its entirety, and which claims priority to German Patent Application No. 102004061314.1, filed on Dec. 20, 2004.

TECHNICAL FIELD

The present invention relates to the technical field of acoustics and, in particular, the present invention relates to the technical sub-field of loudspeaker technology.

BACKGROUND

The trend towards constructing everything to be smaller and more compact evolving in consumer electronics also applies to loudspeaker technology. Today, loudspeakers are not only to be small, but also "invisible". In particular for multi-channel reproduction, such as, for example, surround and wave field synthesis (WFS), a possible invisible installation is of great advantage. The number of individual channels, and thus of loudspeakers, necessary is easily more than 50. Since reproduction systems of this kind are also to be developed and offered for private usage, it has to be assumed that for reasons of space the customer will not equip his or her living room with 50 conventional loudspeakers, such as, for example, for a WFS system.

A loudspeaker the diaphragm of which is as flat as a plate and the electro-acoustic exciter system of which has the smallest dimensions possible is suitable here.

Patent research has shown that such a construction was already filed in 1927 by Dietze, Bothe and Bauch (see patents 456189, 484409 or 484872 of the German National Patent Office). In this case, a shop window pane, as a diaphragm, was excited to reproduce sound by an electrodynamic exciter system applied. This principle of using a plate coupled to an exciter system as a diaphragm has been adopted again over the last few years.

Thus, a flat loudspeaker, as is exemplarily illustrated in FIG. 6A, in its most simple implementation, consists of an electrodynamic exciter unit 60 serving to excite the waves, and a stiff plate diaphragm 62 for emitting acoustic sound waves.

In correspondence with the term "flat loudspeaker", the construction has a smaller setup depth compared to a conventional piston loudspeaker, which is, among other things, due to the comparatively large and planar diaphragm surface.

Bending vibrations are excited in the plate diaphragm 62 by audio-frequency vibrational movements by means of the electrodynamic exciter unit 60. The consequence is the propagation of bending waves in the plate and/or the plate diaphragm 62, which form a wave field. This principle is also referred to as solid-borne sound. In an interaction with the surrounding medium (exemplarily air), this wave field is emitted as sound (airborne sound). Consequently, at first there is a transformation of the longitudinal exciter vibration into solid-borne sound, before further propagating as airborne sound. A similar transformation has already been described in greater detail in the German patent application DE 10238325 A1.

The transformation from solid-borne sound to airborne sound has a similar effect as a filter in a signal chain. Specifically, only those signal portions can be reproduced as airborne sound which have been generated before in the plate as solid-borne sound. Thus, the solid-borne sound portion propagating in the form of a bending wave is the most important one. Wave reflections as are exemplarily illustrated in greater detail in FIG. 6B are, apart from excitation and propagation due to material, of considerable influence for the characteristics of the bending wave. These wave reflections form by inhomogeneities in the plate material, but particularly by abrupt plate ends and/or plate terminations, as is shown in FIG. 6B at the plate end 64. Inward-propagating or reflected wave portions 66 thus overlap propagating wave portions 68 that have just been excited and cause, apart from forming modes, more generally a change in the amplitude distribution. Furthermore, resonances develop on the diaphragm 62 in the form of standing waves.

All in all, wave reflections result in uncontrolled (chaotic) vibrational behavior. It has been proved that this has disadvantageous effects on the sound characteristics of the flat loudspeaker.

A suggestion for solving this problem has been made by O. Bschorr, where impedance matching by means of active and passive structures is cited (DE 10046059, DE 2412672, DE 22229420). In this context, Krylov and Tilman talk about "acoustic 'black holes' for flexural waves as effective vibration dampers" in Journal of Sound and Vibration, 274 (2004), pp. 605-619, Elsevier).

SUMMARY

According to an embodiment, a loudspeaker diaphragm may have a tapering edge region and an otherwise constant thickness which is implemented such that solid-borne sound can propagate within it in the form of bending waves, thereby exciting airborne sound, wherein, on a surface of the tapering edge region, a surface structure or a surface layer which has a greater attenuation factor with regard to a mechanical wave propagating than a material of the tapering edge region and which is thinner than half the thickness of the tapering edge region is formed.

According to another embodiment, a loudspeaker may have a loudspeaker diaphragm as described above; and an exciter unit connected to the loudspeaker diaphragm, wherein the exciter unit is further implemented to vibrate the loudspeaker diaphragm responsive to an electrical signal so that it will generate an acoustic vibration corresponding to the electrical signal.

According to another embodiment, a loudspeaker hay have: a stiff loudspeaker diaphragm including a tapering edge region and an exciter unit for generating solid-borne sound in the loudspeaker diaphragm, wherein, on a surface of the tapering edge region, a surface structure or a surface layer which has a greater attenuation factor with regard to a mechanical wave propagating than a material of the tapering edge region and which is thinner than half the thickness of the tapering edge region is formed.

According to another embodiment, a method for manufacturing a loudspeaker diaphragm including a tapering edge region which is implemented such that solid-borne sound can propagate in it in the form of bending waves, thereby exciting airborne sound, may have the steps of: providing a loudspeaker diaphragm; removing material from an edge region of the loudspeaker diaphragm to implement the tapering edge region such that solid-borne sound can propagate in it in the form of bending waves, thereby exciting airborne sound; and forming a surface structure or a surface layer on a surface of the tapering edge region so that it has a greater attenuation factor with regard to a mechanical wave propagating than a material of the tapering edge region and is thinner than half the thickness of the tapering edge region.

According to another embodiment, a method for manufacturing a loudspeaker diaphragm including a tapering edge region which is implemented such that solid-body sound can propagate in it in the form of bending waves, thereby exciting airborne sound, may have the steps of: forming a loudspeaker diaphragm, the forming taking place such that a loudspeaker diaphragm is formed in which an edge region of the loudspeaker diaphragm tapers such that solid-borne sound can propagate in it in the form of bending waves, thereby exciting airborne sound; and forming a surface structure or a surface layer on a surface of the tapering edge region so that it has a greater attenuation factor with regard to a mechanical wave propagating than a material of the tapering edge region and is thinner than half the thickness of the tapering edge region.

Embodiments of the present invention are based on the finding that a loudspeaker diaphragm the outer edge region of which is designed with regard to its form and structure to be different compared to a conventional loudspeaker diaphragm is provided, thereby providing an outline realizing impedance matching and thus offering a specifically matched wave termination for every frequency. This principle of avoiding reflections may also be referred to as broadband absorber. Adjusting the edge quality is thus a decisive aspect of the solution. Thus, the integration of the absorber in the diaphragm plate itself is to be pointed out, in contrast to different solutions for avoiding and/or reducing reflections which are essentially all based on absorber principles. The plate diaphragm, as a continuous device, consequently includes both the actual "acoustic area" and the edge structure designed for wave absorption.

The advantage of such a construction of a loudspeaker diaphragm, on the one hand, is cheap manufacturing, since attaching external absorber structures can be omitted, and, on the other hand, maintaining the aesthetic appearance of a flat loudspeaker in which any additional external attributes can be dispensed with. Furthermore, an advantage of the inventive loudspeaker diaphragm is that an absorption characteristic considerably improved compared to conventional plate diaphragms is formed due to the tapering edge region.

Another advantage is the construction which, in relation to conventional loudspeaker diaphragms, is simple as far as manufacturing technology is concerned, which in addition has no further inhomogeneities between the diaphragm and the absorber.

In practice, this means that nearly any area of an ordinary object may principally be used, with certain limitations, as a plate diaphragm of the flat loudspeaker, such as, for example, the doors of a wardrobe.

According to an embodiment, the tapering edge region is an absorption region extending with decreasing thickness from an acoustic area of the loudspeaker diaphragm to an outer edge of the loudspeaker diaphragm. This has the advantage of simple manufacturing.

In addition, at a transition to the acoustic area, the absorption wedge region can comprise a thickness corresponding to the thickness of the loudspeaker diaphragm in the acoustic area. This offers advantageous characteristics with regard to avoiding reflections at the transition between the acoustic area and the absorption wedge region.

It is also of advantage for a thickness of the absorption wedge region to approach zero at the outer edge of the loudspeaker diaphragm since this has a high attenuating effect on nearly any vibration modes which may occur in the loudspeaker diaphragm.

In a favorable embodiment, the loudspeaker diaphragm may comprise another tapering edge region arranged on the loudspeaker diaphragm side opposite the tapering edge region. The advantage here is that this has a considerably stronger attenuating effect than in the case in which a tapering edge region is only arranged on one side of the loudspeaker diaphragm.

In addition, the tapering edge region may also laterally completely surround the loudspeaker diaphragm. This is of advantage in that not only a standing wave is attenuated or prevented on two sides of the loudspeaker diaphragm, but also transversely propagating standing waves are attenuated or prevented, thereby resulting in a considerable increase in the number of waves which may have to be attenuated by the edge region.

In another embodiment, the tapering edge region may comprise convexly inward curved region. This is of particular advantage due to the simple manufacturing of such a structure.

Alternatively, the loudspeaker diaphragm may also include a tapering edge region including a first concavely outward curved sub-region abutting on the acoustic area, wherein in addition the tapering edge region includes a convexly inward curved sub-region abutting on the first sub-region. This is of advantage in the attenuating characteristic since an edge (i.e. from a mathematical point of view a non-differentiable position) at a transition between the acoustic area and the absorption wedge region is avoided and thus an improvement in reflection loss can be expected.

In addition, the shape of the convexly inward curved region may be described by a mathematical function which is based on the power law or an inversion of the power law, wherein inputting a mathematical formula has a considerably relieving effect, exemplarily when manufacturing by a computer-aided milling machine.

In addition, a thickness of the tapering edge region may be described by a mathematical function based on the sine function. Here, an edge at a transition between the acoustic area and the absorption wedge region can be avoided when the distance between the external edge of the edge region and the transition between the acoustic area and the absorption wedge region corresponds to a length of $\pi/4$ (or a scaled version thereof).

It is also of advantage for the loudspeaker diaphragm to include a polymer or a polycondensate. This offers advantages as far as manufacturing technology is concerned by applying well-known and well-tried plastic-processing operating modes.

Furthermore, a surface of the tapering edge region can comprise a surface layer the material of which differs from the material of the loudspeaker diaphragm. This has advantages for the attenuation characteristic, wherein at the same time simple manufacturing of such a surface layer is possible.

Also, the surface layer can comprise a layer thickness corresponding to at most half of the thickness of the tapering edge region at the corresponding position, which also exhibits an attenuation characteristic further improved.

Additionally, the material of the surface layer can comprise a higher attenuation factor with regard to propagation of a mechanical wave than a material of the tapering edge region.

Apart from increasing the attenuation by the shape of the edge region, this offers an increase in the attenuation by using corresponding materials.

In a suitable embodiment, a plastic film or a varnish may be arranged on the surface of the tapering edge region. From the point of view of manufacturing technology, this is of particular advantage since the plastic layer or the varnish may be formed by an injection-molding or immersion process, where several loudspeaker diaphragms can be processed at the same time.

Furthermore, an attenuation structure may be formed on a surface of the tapering edge region. This has the advantage that the effects of an additional deposited surface layer can also be achieved when no surface layer can be deposited for reasons of manufacturing technology.

Additionally, the tapering edge region may also be embedded in an attenuation material surrounding the tapering edge region, a surface layer or a surface structure on the tapering edge region. This offers advantages for mounting, since a very thin edge region at the sides is otherwise very difficult to process without damaging or destroying the edge region.

In particular, the attenuation material may be a silicon cladding or a fine-pore rigid foam which can easily be deposited around the edge region.

Embodiments of the invention offer the advantage of providing not only the loudspeaker diaphragms, but also an already operational loudspeaker which can be used directly in a WFS system.

In addition, removing may include milling. This offers a simple way of manufacturing such a loudspeaker diaphragm.

In addition, removing may include depositing solvents onto the material of the edge region, thereby resulting in further simplification of the manufacturing of such a loudspeaker diaphragm.

In particular, the step of forming may take place using a corresponding pre-shaped form where a tapering in an edge region is pre-structured. This represents further optimization for a loudspeaker diaphragm mass production where special post-processing of the edge regions due to manufacturing can be avoided.

Another embodiment of the present invention may be for the step of forming to include extruding the edge region or an etching method or layering method. This is of advantage when a simultaneous production of the tapering edge region is not possible for the entire loudspeaker diaphragm or when removing material is considered as impractical (exemplarily due to a high rejection rate).

BRIEF DESCRIPTION OF THE DRAWINGS

Embodiments will be explained subsequently in greater detail referring to the appended drawings, in which.

DETAILED DESCRIPTION

Figure 1A:
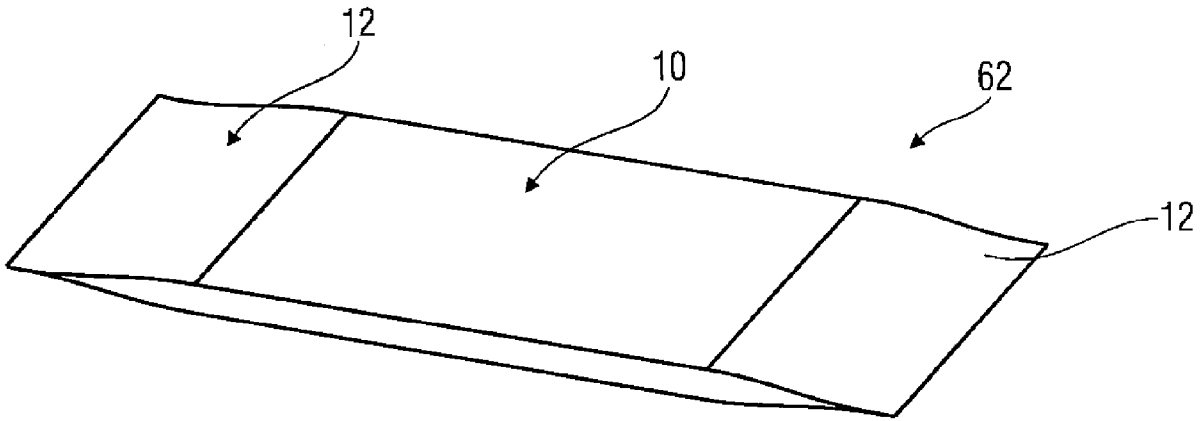
FIG. 1A is a perspective representation of a first embodiment of the inventive loudspeaker diaphragm.

In the following description, same or similar reference numerals are used for same or similar elements, a repeated description of these reference numerals being omitted.

FIG. 1A shows a first embodiment of the inventive loudspeaker diaphragm. The loudspeaker diaphragm 62 comprises an acoustic area 10 and an absorption wedge region 12. An absorption wedge region 12 each is arranged at two ends of the acoustic area 10. This absorption wedge region corresponds to a defined tapering of the plate, i.e. the loudspeaker diaphragm 62, which ideally approaches zero towards the plate end. This material tapering may be visualized as a "wedge" which, starting from the homogenous thickness of the acoustic area 10, runs out to a zero thickness.

The practical realization of the inventive approach may thus take place in different ways. On the one hand, a homogenous plate can be started from, wherein the term homogenous refers to a material quality, but also with regard to a constant thickness. The tapering may exemplarily be performed by means of a CNC milling technique. Extruding or casting and/or injection molding or chemically solving material in the edge region, etc., is also conceivable.

In particular, plastics, such as, for example, various members of the polymers or polycondesates, are suitable for the absorption wedge region 12 (and, of course, also for the acoustic area 10).

Figure 1B:
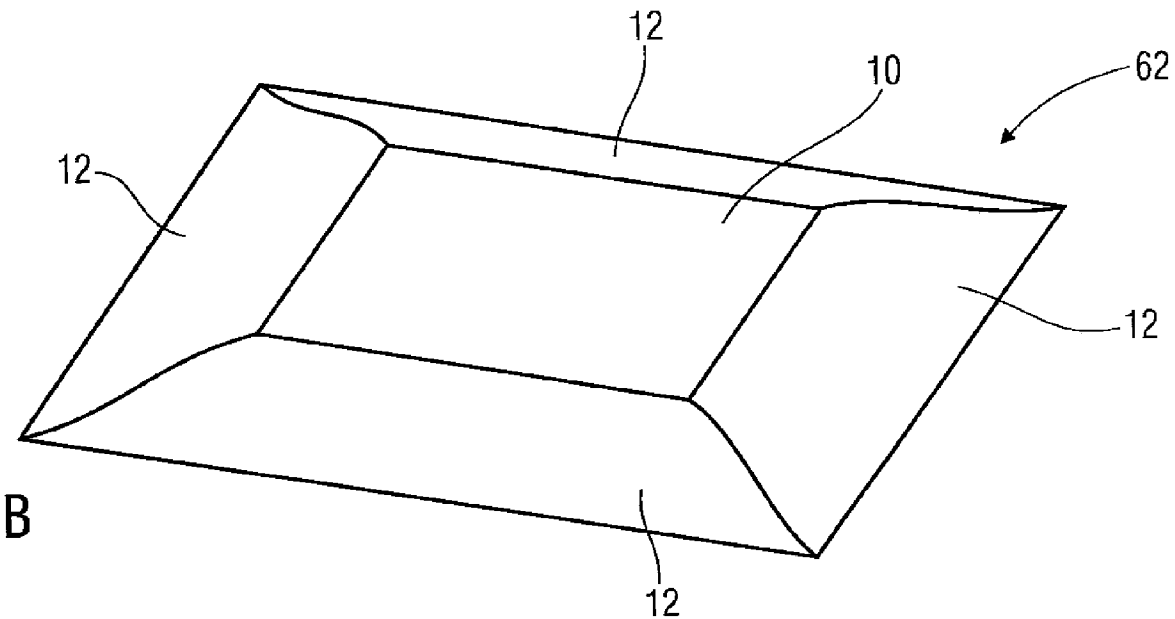
FIG. 1B is a perspective representation of a second embodiment of the inventive loudspeaker diaphragm.

FIG. 1B shows another embodiment of the inventive loudspeaker diaphragm. Here, the loudspeaker diaphragm comprises a central acoustic area 10 which is continuously surrounded by a "ring" of an absorption wedge region 12.

Figure 2B:
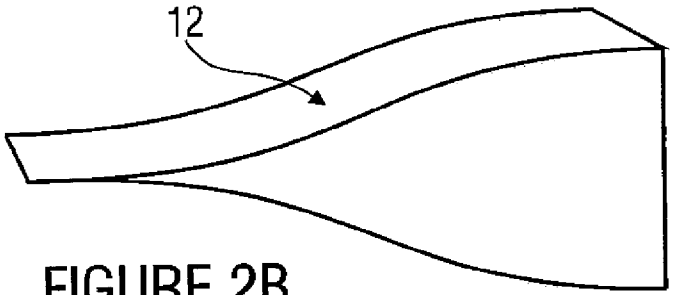
FIG. 2B is a perspective representation of the shape of another embodiment of the tapering edge region.
Figure 2A:
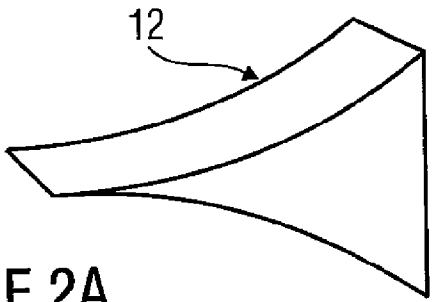
FIG. 2A is a perspective representation of the shape of an embodiment of the tapering edge region.

A number of possible embodiments for the shape of the tapering edge region are illustrated in FIGS. 2A and 2B. Several shapes have proven practical for the precise outline of the plate edge, since they allow a particularly quick reduction of the reflection coefficient with, at the same time, small dimensions. Special outlines represented as cross sections which, towards the plate end, take a shape which is based on the mathematical power law including the inverse function thereof (as is illustrated in FIG. 2A), but also outlines based on a sinusoidal shaping towards the plate end (as is illustrated in FIG. 2B, in which the thickness of the absorption wedge region is based on a sine shape) may be realized easily in practice.

An important prerequisite when creating an outline is a "harmonic" connection to the "acoustic area" to avoid potential inhomogeneities and renewed wave reflection. Such a "harmonic" connection may particularly be formed when the thickness of the absorber wedge region at a boundary to the acoustic area also corresponds to the thickness of the acoustic area since in this case no "steps" and no "break" occur in the material of the loudspeaker diaphragm where undesired reflections may be generated.

In general, it is to be mentioned that the tapering edge structure including the absorber characteristic is not limited to the special structures mentioned before, but that rather any tapering structure possible can be used in the edge region as an absorber.

Figure 3B:
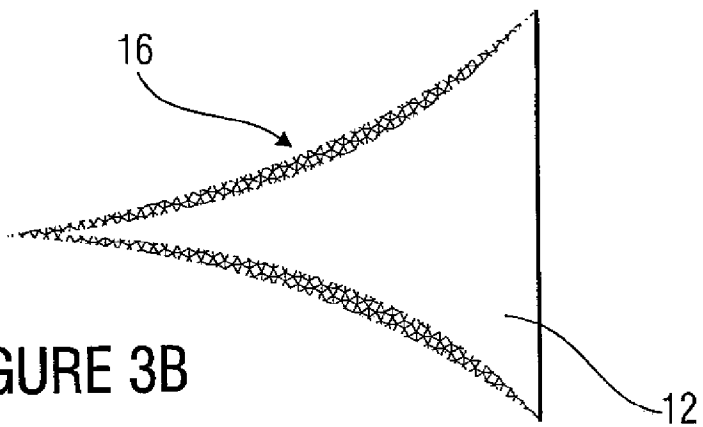
FIG. 3B is a cross-sectional representation of an embodiment of a structured tapering edge region.
Figure 3A:
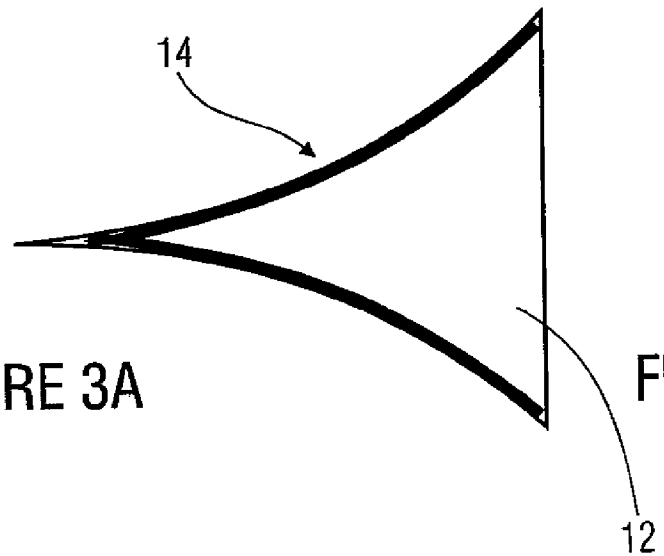
FIG. 3A is a cross-sectional representation of an embodiment of a coated tapering edge region.

In addition to the material tapering in the edge region of the loudspeaker diaphragm, a specific surface coating can be deposited on the surface of the absorber wedge region 12, acting as additional attenuation material. This is exemplarily illustrated in FIG. 3A, where a thin layer 14 is deposited on the surface of the tapering edge region 12 of the loudspeaker diaphragm. This surface coating does not necessarily have to be deposited as a separate component. Rather, it would also be conceivable to only deposit a surface structure on a surface of the absorption wedge region 12, as is illustrated in FIG. 3B by the surface structure 16 deposited, which may be manufactured by only processing the surface of the absorption wedge region 12. Thus, it would also be conceivable to use a method changing the surface structure of the support material, i.e. of the absorption wedge region 12 of the loudspeaker diaphragm 62 in correspondence with defined defaults. These defaults may exemplarily be that, on the one hand, the thickness of the surface coating and/or the surface structure be much thinner than that of the support material, i.e. of the material of the absorption wedge region 12. Additionally, the material of the surface coating 14 and/or the surface structure 16 should have the greatest possible loss factor with regard to an attenuation of mechanical waves, i.e. allow the greatest possible attenuation of the waves propagating in the acoustic area 10 and the absorption wedge region 12.

In particular by simultaneously applying the components of material tapering and surface coating and/or surface structuring, a considerable reduction of the reflection coefficients compared to conventional flat loudspeaker diaphragms is possible. With regard to surface coating and/or surface structuring, it may also be added that this may be realized in different manners. Depending on the material quality, manufacturing-technological processes, like varnishing or evaporation, etc., are conceivable. As has already been mentioned, some defaults should be kept in mind here. In particular, the surface coating is to be much thinner than the loudspeaker diaphragm and/or the thickness of the loudspeaker diaphragm at the corresponding position in the absorption wedge region 12. In this context, an example is a value of about half the thickness of the loudspeaker diaphragm at the corresponding position in the absorption wedge region. This default, however, will be relative with an ideal wedge approaching zero. Additionally, the surface material should have a greater loss factor than the support material. Here, too, special plastics which are exemplarily deposited as a thin polymer film are suitable. Additionally, good results can also be obtained when depositing a liquid plastic onto the surface of the absorption wedge region 12. Thus, the surface structure of the support material, i.e. of the absorption wedge region, changes irreversibly and thus exemplarily forms the surface structure 16, as is shown in FIG. 3B. Such a structuring, however, nevertheless corresponds to the default desired. Correspondingly, a method not introducing new material components into the setup, but only relying on changing the surface structure of the plate diaphragm 62, in particular in the absorption wedge region 12, would also be conceivable, as is illustrated in FIG. 3B.

Figure 4:
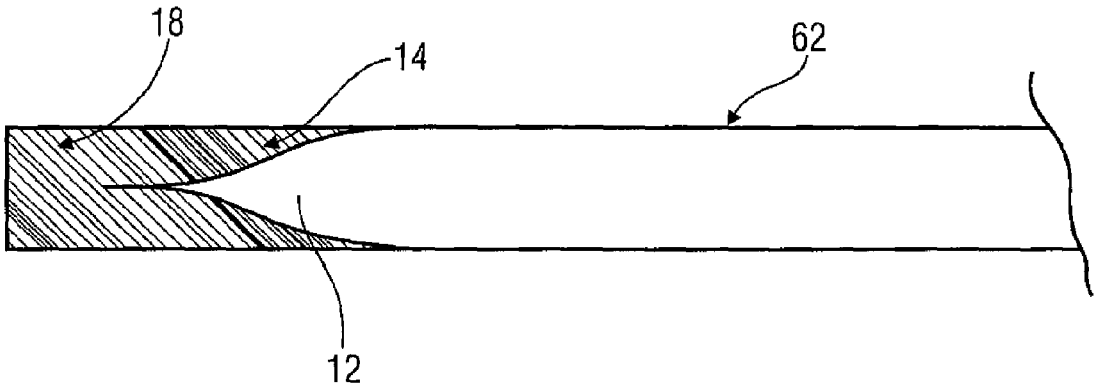
FIG. 4 is a cross-sectional representation of a tapering edge region including an additional element around the tapering edge region.

However, a constant thick and stable plate edge proves to be particularly suitable for mounting the diaphragm 62. Thus, additionally there is the possibility of embedding the sensitive tapering structure in the edge region of the loudspeaker diaphragm 62 in a material taking on the outline of the tapering edge region and compensating the difference in height between the loudspeaker diaphragm and the tapering edge region, i.e. the absorption wedge region 12. This may exemplarily take place by a kind of foaming such that the absorption wedge structure 12 is embedded in a fine-pore rigid foam 18, as is illustrated in greater detail in FIG. 4. Exemplarily, the absorption wedge structure 12 here is provided with a surface coating 14, after which the absorption wedge region 12 processed in this manner is surrounded by the fine-pore rigid foam 18, thereby making subsequent processing, in particular installation of the loudspeaker diaphragm 62, easier. The physical effect of the absorption wedge region 12 is not impeded by such a foaming, but rather a further attenuation effect can be achieved with a suitable design of the fine-pore rigid foam or a similar suitable material.

Figure 5A:
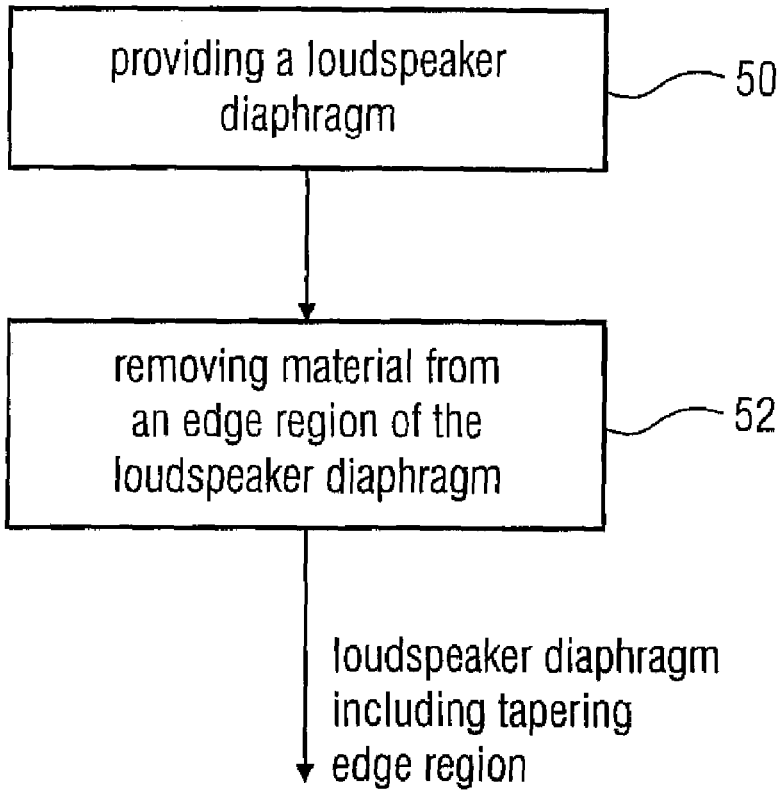
FIG. 5A is a flowchart of a first embodiment of the inventive method for manufacturing a loudspeaker diaphragm.

FIG. 5A shows a flowchart of a first embodiment of the inventive method for manufacturing a loudspeaker diaphragm. At first, in a first step 50, a loudspeaker diaphragm is provided, followed by, in a second step 52, removing material at the edge region of the loudspeaker diaphragm to obtain the loudspeaker diaphragm including the tapering edge region. As has already been explained before, this removing may be performed by milling, grinding or also by chemically removing using a solvent or etchant.

Figure 5B:
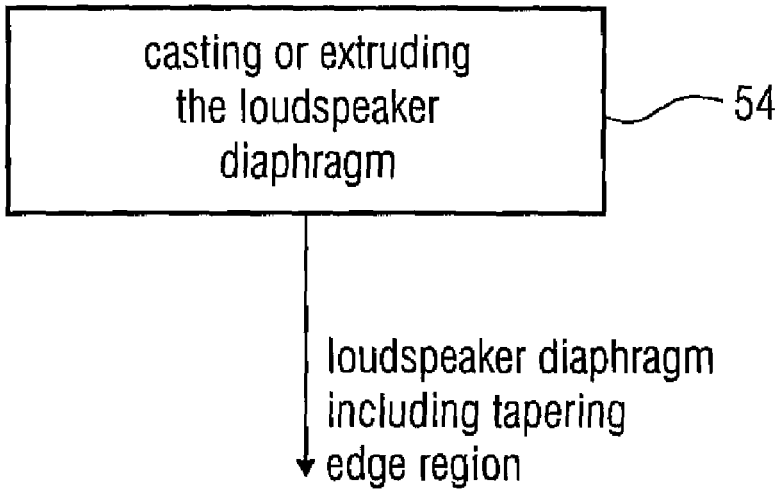
FIG. 5B is a flowchart of another embodiment of the inventive method for manufacturing a loudspeaker diaphragm.
Figure 6A:
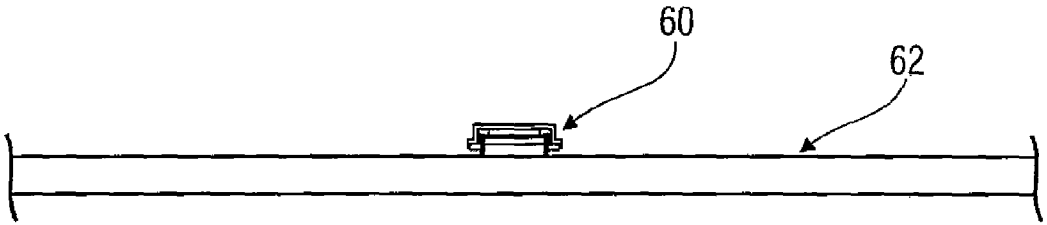
FIGURE 6A Prior Art
FIG. 6A shows a conventional loudspeaker diaphragm.
Figure 6B:
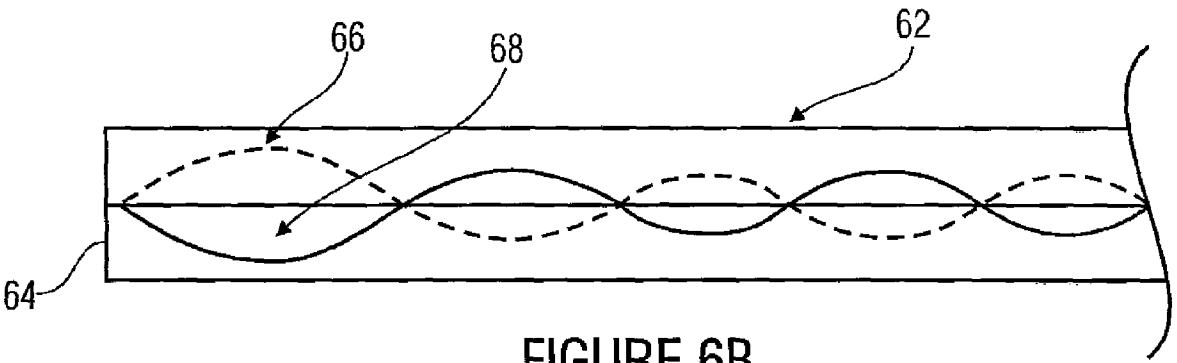
FIGURE 6B Prior Art
FIG. 6B is a representation of the formation of a standing wave and a reflected wave in a conventional loudspeaker diaphragm.

FIG. 5B shows another embodiment of the inventive method for manufacturing a loudspeaker diaphragm in the form of a flowchart. Here, in a first step 54 of the second embodiment, forming the loudspeaker diaphragm is performed to obtain the loudspeaker diaphragm including the tapering edge region. Forming may thus be performed by casting or layering, wherein casting here means injection molding or injecting. A shape produced before can be considered here as an important feature, in which corresponding provisions for forming the tapering structure in the edge region of the loudspeaker diaphragm produced by this shape are already there. By casting or injecting using this shape, the loudspeaker diaphragm including the tapering edge region can be manufactured very easily.

Furthermore, a loudspeaker diaphragm manufactured can also be extruded such that a tapering structure in the edge region of the loudspeaker diaphragm is formed in a rolling or pressing step. In addition, the loudspeaker diaphragm may also be clamped and "drawn" in the etch region, thereby forming the absorption wedge region including the tapering edge structure mentioned before.

In another embodiment, a softener exemplarily acts on the tapering region so that it is made softer and/or softened, thereby reducing reflections at the edge. Exemplarily, a chemical softener is deposited on a surface region of the tapering edge region. It may then remain on the tapering edge region as an alternative surface layer to the layers described before. The softener reacts with the material of the tapering edge region so that a softer structure forms in the tapering edge region starting from the surface of the tapering edge region. The result of this, in turn, is an improved attenuation effect.

In summary, it can be stated that wave reflections in the loudspeaker diaphragm can be avoided and/or reduced by using an absorber formed by a tapering structure in the edge region of a loudspeaker diaphragm. In particular, forming the absorber as a wedge, exemplarily in combination with a surface coating or a surface structuring, allows additional attenuation of a wave propagating in the loudspeaker diaphragm. In addition, this absorber can be integrated directly in the diaphragm area, no additional component being necessary. A theoretically unlimited area with practically limited dimensions of the loudspeaker diaphragm can be achieved by avoiding and/or reducing wave reflections. Thus, modes can largely be prevented from forming and/or be reduced, allowing a nearly ideal wave propagation. In this way, hardly any diaphragm resonances, i.e. standing waves, form on the diaphragm.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. A loudspeaker diaphragm including a tapering edge region and an otherwise constant thickness which is implemented such that solid-borne sound can propagate within it in the form of bending waves, thereby exciting airborne sound, wherein, on a surface of the tapering edge region, a surface structure or a surface layer is formed which comprises a greater attenuation factor with regard to a mechanical wave propagating than a material of the tapering edge region and which is thinner than half the thickness of the tapering edge region at the corresponding position.

2. The loudspeaker diaphragm according to claim 1, wherein the tapering edge region is a wedge-shaped region extending with a decreasing thickness from a mean body region of the loudspeaker diaphragm to an outer edge of the loudspeaker diaphragm.

3. The loudspeaker diaphragm according to claim 2, wherein the edge region tapering in the shape of a wedge comprises, at a transition to the main body region, a thickness corresponding to the thickness of the loudspeaker diaphragm in the main body region.

4. The loudspeaker diaphragm according to claim 2, wherein a thickness of the edge region tapering in the shape of a wedge approaches zero at the outer edge of the loudspeaker diaphragm.

5. The loudspeaker diaphragm according to claim 1, further comprising another tapering edge region which is arranged on a side of the loudspeaker diaphragm opposite the tapering edge region.

6. The loudspeaker diaphragm according to claim 1, wherein the tapering edge region laterally completely surrounds the loudspeaker diaphragm.

7. The loudspeaker diaphragm according to claim 1, wherein the tapering edge region includes a convexly inward curved region.

8. The loudspeaker diaphragm according to claim 1, wherein the tapering edge region includes a concavely outward curved first sub-region abutting on the main body region, and wherein further the tapering edge region includes a convexly inward curved sub-region abutting on the first sub-region.

9. The loudspeaker diaphragm according to claim 8, wherein a thickness of the tapering edge region (12) is describable by a mathematical function based on the sine function.

10. The loudspeaker diaphragm according to claim 1, wherein the loudspeaker diaphragm includes a polymer or a polycondensate.

11. The loudspeaker diaphragm according to claim 1, wherein the surface layer comprises a material which differs from the material of the loudspeaker diaphragm.

12. The loudspeaker diaphragm according to claim 11, wherein a polymer film or a varnish is arranged as attenuation layer on the surface of the tapering edge region.

13. The loudspeaker diaphragm according to claim 1, wherein the attenuation structure is porous.

14. The loudspeaker diaphragm according to claim 1, wherein the tapering edge region is embedded in an attenuation material surrounding the surface layer or the surface structure on the tapering edge region.

15. The loudspeaker diaphragm according to claim 14, wherein the attenuation material is a fine-pore rigid foam.

16. The loudspeaker diaphragm according to claim 1, wherein the surface layer includes a softener.

17. A loudspeaker comprising:

a loudspeaker diaphragm including a tapering edge region and an otherwise constant thickness which is implemented such that solid-borne sound can propagate within it in the form of bending waves, thereby exciting airborne sound, wherein, on a surface of the tapering edge region, a surface structure or a surface layer which comprises a greater attenuation factor with regard to a mechanical wave propagating than a material of the tapering edge region and which is thinner than half the thickness of the tapering edge region is formed; and an exciter unit connected to the loudspeaker diaphragm, wherein the exciter unit is further implemented to vibrate the loudspeaker diaphragm responsive to an electrical signal so that it will generate an acoustic vibration corresponding to the electrical signal.

18. The loudspeaker according to claim 17, wherein the exciter unit includes a coil or a magnet.

19. A loudspeaker comprising:

a stiff loudspeaker diaphragm including a tapering edge region and an exciter unit for generating solid-borne sound in the loudspeaker diaphragm, wherein, on a surface of the tapering edge region, a surface structure or a surface layer is formed which comprises a greater attenuation factor with regard to a mechanical wave propagating than a material of the tapering edge region and which is thinner than half the thickness of the tapering edge region at the corresponding position.

* * * * *